United States Patent [19]

Hoffmann et al.

[11] 4,374,322

[45] Feb. 15, 1983

[54] APPARATUS FOR CONTROLLING THE ABSORPTION OF ONE OR MORE COLOR COMPONENTS IN A DYEING FLUID

[75] Inventors: Erich Hoffmann, Freigericht; Werner Ptaschek, Bruchköbel, both of Fed. Rep. of Germany

[73] Assignee: W. C. Heraeus GmbH, Hanau, Fed. Rep. of Germany

[21] Appl. No.: 143,441

[22] Filed: Apr. 24, 1980

[30] Foreign Application Priority Data

Apr. 27, 1979 [DE] Fed. Rep. of Germany ..... 2917075

[51] Int. Cl.[3] ..... G01J 3/34

[52] U.S. Cl. ..... 250/226; 356/411; 250/565

[58] Field of Search ..... 250/226, 214 R, 231 R, 250/565; 356/409, 410, 411, 436, 223; 219/502; 8/400

[56] References Cited

U.S. PATENT DOCUMENTS

| | | | |
|---|---|---|---|
| 3,664,744 | 5/1972 | Liston | 250/226 |
| 3,867,040 | 2/1975 | Loffler et al. | 8/400 |
| 3,890,510 | 6/1975 | Sturm | 250/565 |
| 3,953,739 | 4/1976 | Colombo et al. | 250/226 |
| 4,015,134 | 3/1977 | Sturm | 250/565 |
| 4,089,644 | 5/1978 | Carbonell et al. | 8/400 |
| 4,180,722 | 12/1979 | Clewans | 219/502 |

*Primary Examiner*—David C. Nelms

*Attorney, Agent, or Firm*—Frishauf, Holtz, Goodman & Woodward

[57] ABSTRACT

The temperature of the dye bath in a vat or trough (1) is controlled in dependence on absorption change, which is photometrically sensed. A command value of dye acceptance speed related to temperature of the dye within the vat is provided, compared with actual temperature, and a control signal is derived which, in turn, controls a heat exchanger supplied, selectively, with a heating or cooling medium in order to control dye acceptance of at least one predetermined dye component of the bath by the material therein.

14 Claims, 5 Drawing Figures

APPARATUS FOR CONTROLLING THE ABSORPTION OF ONE OR MORE COLOR COMPONENTS IN A DYEING FLUID

FIELD OF THE INVENTION

The present invention relates to a system for controlling the absorption rate of at least one color component contained in a dye bath or liquor on textile material or the like by governing the temperature as a function of the change in extinction which is detected by a photometer.

BACKGROUND AND PRIOR ART

A known type of apparatus for controlling dye exhaustion in a textile dyeing bath or vat is described in U.S. Pat. Nos. 3,890,510 and 4,015,134 assigned to the same Assignee as this application. In such apparatus the absorption of a color component is controlled by regulating the temperature dependent on the transparency of the dyeing fluid.

Factors influencing the evenness of dyeings in a bath dyeing operation of this type are:

The temperature/time program, dye formula, liquor characteristics such as the pH value, liquor circulation, textile material characteristics such as type of fibre etc.

With hitherto employed dyeing methods these factors had to be balanced out with each other to such an extent that the limit value dyeing rate was achieved with time-dependent linear exhaustion of the dye on the fibres with as good as possible approximation.

SUMMARY OF THE INVENTION

It is an object of the invention to provide an improved linearity of the dye-stuff exhaustion control dyes difficult to control, e.g. for the dyeing of acrylics. Another object of the invention is to shorten the dyeing time as much as possible.

Briefly, a system for controlling the exhaustion rate of at least one color component contained in a dye bath or liquor on textile material or the like is provided, in which the temperature is governed as a function of the change in extinction which is detected by a photometer. The actual value obtained by means of the photometer for the dye exhaustion rate is compared to a presettable rated value for the dye exhaustion rate, and the control quantity thus obtained is fed to a dye exhaustion control unit, which, by means of a rated value generator, establishes a rated temperature value for a temperature governor to control the temperature of the dye vat. The actual temperature value of the dye vat thereof, is sensed and compared with the desired central temperature value derived from the control quantity of the dye exhaustion control unit for control of a temperature controlling system thereby.

The dye exhaustion, controlled by dyeing bath temperature, is regulated dependent on time in such a way that a preselectable bath impoverishment of dye per unit of time (dye exhaustion rate) is achieved within close tolerances over the complete exhaustion phase. The dye exhaustion rate can be preselected according to the operational conditions, which may be given approximately, over a range of 1 to 10% per min. (with a maximum admissible given absolute deviation of the set desired value of ±0.2% per min), in which 100% refers to the maximum exhaustion rate $E_{max}$.

Corresponding to a selected operating mode, two measured values are called up continuously as regulating factors from the existing dyeing system or dyeing apparatus, i.e. the amount of dye in the dyeing liquor and the dyeing bath temperature. The measured values are the input values for the continuous regulating system. The output of the controller is a continuous signal to control the setting element, whereby different output signal ranges can be achieved. One usual output signal is, for example, a continuous signal of 0 to 20 mA, which is converted into a pneumatic signal through an electropneumatic converter. The latter actuates, for example, pneumatic diaphragm valves which position controllers in the heating or cooling medium coil supply for the liquor in the vat.

The control system of the invention uses a measuring system in the form of a dual beam photometer and a regulating system for the dye exhaustion rate. With this type of photometer errors due to intensity variations or similar influences are eliminated.

Advantages which could be achieved with the invention are that a commanded dye exhaustion rate can be controlled through temperature control of the dyeing liquor during the entire exhaustion phase; Continuous measuring of the bath exhaustion when dyeing with soluble dyes.

Optimization of the dyeing processes, particularly with polyacrylonitrile fibres. Shortening of the dyeing time without losing reliability.

Control when dyeing polyacrylonitrile fibres. Troublefree dyeing of different or unknown types of polyacrylonitrile fibres.

Testing the kinetic dyeing properties of dyes and fibres in different dyeing processes.

DESCRIPTION OF THE PREFERRED EMBODIMENT

Figure 1:
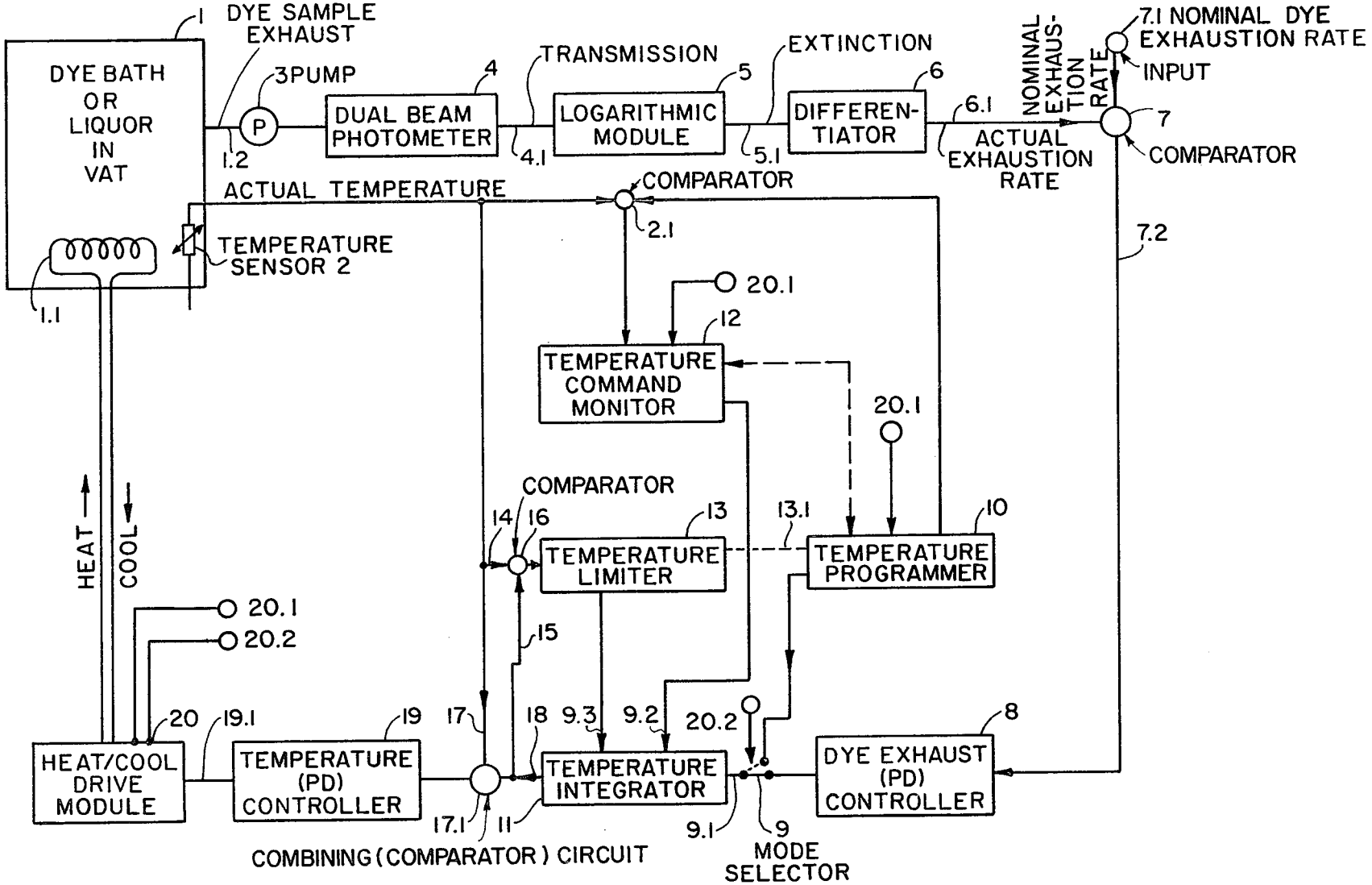
FIG. 1 is a highly schematic block diagram of the control device for dyeing fluids.

A dyeing vat 1, FIG. 1, intended to receive a dye bath or liquor which is to be heated or cooled, contains the dye components and the textile or merchandise which is to be dyed. The heating or cooling system is not illustrated in detail, since it may be of any kind known per se. Heating or cooling may be performed electrically or by means of a heating or cooling fluid, e.g. water or steam, which is to be circulated through a coil 1.1 in vat 1. A temperature sensor 2 is situated in the dye tank such as the vat 1, e.g. a resistance thermometer referred to in the trade as of type Pt100. A pump 3 continuously draws a sample quantity of the liquor from the dye tank 1 and feeds the same to a photometer 4, which is preferably a double-beam photometer. The ratio of light, representative of degree of transmission between the measurement values derived from the light beams entering and leaving the absorbing solution in the double-beam photometer is established, and an extinction value E corresponding to the dye exhaustion in the dye bath 1 is determined in a logarithmic module 5.

MEASURING SYSTEM

An important basis for the function of the control system is the photometric determination of the amount of dye in the dyeing bath, i.e. the dye concentration. Use of the regulating system in the dye supply calls for a photometer for the measuring system designed with the primary object of ensuring reliable operation and easy use with adequate measuring accuracy.

PHYSICAL PRINCIPLES

The photometer works on the principle of the weakening light as a result of an absorbing solution and the linking of the concentration of this solution with the degree of fade in the light (i.e. degree of transmission) by means of the Lambert-Beer law:

$$lg\frac{J_0}{J} = lg\frac{1}{\tau} = E = \text{cons.} \cdot c \cdot d \quad (1)$$

$J_O$=the light beam entering the solution
J=the light beam leaving the solution
$\tau$=degree of transmission
E=(decadic) extinction
d=layer thickness (the solution through which the light beam penetrates)
c=concentration of the solution The linear relation between the extinction value determined with a measuring instrument and the concentration is, strictly speaking only valid for genuine, thinned solutions with constant layer thickness and monochromatic light.

Figure 2:
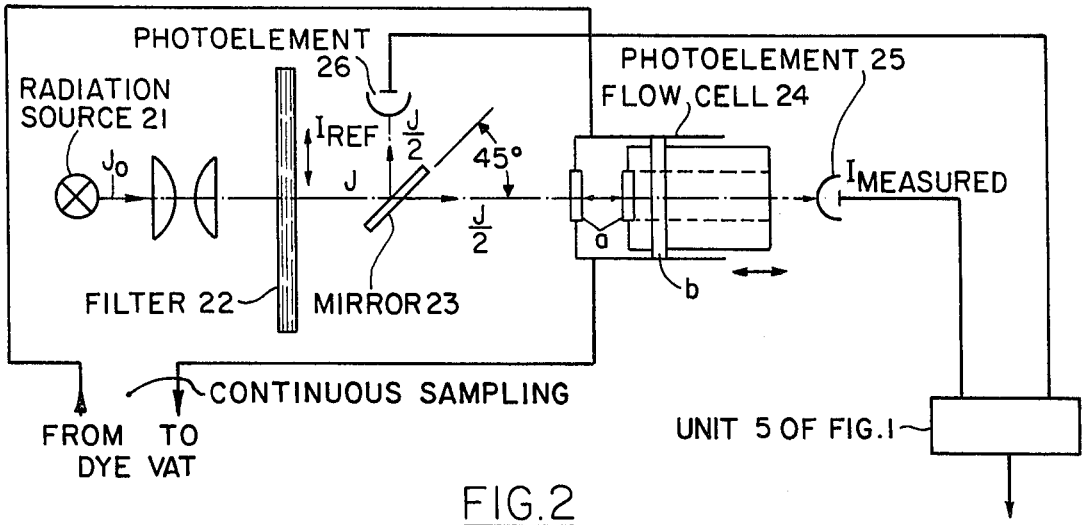
FIG. 2 is a functional diagram of the dual beam photometer as a measuring system.

In accordance with the equation (1) the concentration of the amount of dye in the dyeing bath is determined by means of a transmission measurement. The construction of the photometer can be seen as a schematic diagram in FIG. 2.

From light radiation source (21) the light beam passes through a filter (22) with a wavelength range of 400 to 700 nm and is halved by means of a semi-transmission mirror (23). The reflected light is applied to a first receiver or photo element (26), the transmitted light is sensed by a second receiver or photo element (25). This light also passes through an adjustable flow cell (24) having a shift=layer thickness 1 to 20 mm, with continuous liquor flow. The photo currents are amplified, transformed logarithmically and the extinction value obtained by substraction followed by differentiation. The photometer 4 functions as a dual beam photometer, by which means fluctuations in intensity and changes in the light source are eliminated as sources of errors. The extinction signal is calibrated by the value measured when rinsing out the cell with water i.e. to allow for reflection losses. The influence of the given constant pollution of the cell during the dyeing operation can be eliminated by readjusting this "correction value" (with a setting of 100% dye exhaustion) with a potentiometer. The extinction can take on any value between zero and infinity. It is best to work in the range of maximum sensitivity for measuring the extinction, which is achieved both by limiting the decadic extinction to the range of 0.02 to 2.0 with the liquor in its initial state as well as by measuring in the maximum absorption range of the dye solution or the respective dye at the given wavelength. This calls for a measuring light of varying wavelength, which is achieved through a sky filter in conjunction with a continuous radiator. The greatly varying concentrations of dye met in practice can only be determined within the preset extinction limits by means of variable layer thickness (i.e. adjustment of the cell). Here the given proportionality between the extinction and the layer thickness is used to shift the extinction with given starting concentration in the mentioned sensitivity range (factor 20) in accordance with the equation (1).

The photometer provides a characteristic extinction value for the liquor for a particular moment at any time. In this way the impoverishment of the dyeing liquor in dyestuff per unit of time is determined exactly for both single component dyeing systems and good combinable multi component systems. This is not the case with a multi component system with different dyestuffs with considerably different exhaustion behaviour. In such applications it has been shown that exact control of a given exhaustion rate for the respective different components can only be realised at great expense. This apparatus measures and reproducibly controls the complete solution so that the exhaustion behaviour of the individual dye over time can deviate from the given value for the complete solution with badly combining dyes. The given exhaustion rate can be realized within the determined tolerance limits.

The influence of the time-dependent temperature of the liquor bath on the continuous photometric measurement is eliminated by recooling the circulating dyeing liquor before it enters the measuring cell.

It is not necessary to get an absolute value for the extinction of the dye concentration with the photometer as measuring instrument for the control system, since the measured value obtained for the intial liquor following amplification to a fixed voltage immediately corresponds to the degree of exhaustion as a percentage (0 to 100%). The photometer is put into "operational state" before dyeing is started by means of a simple calibrating operation.

The extinction value E from the logarithmic module 5 is fed to a differentiatior 6 which generates the actual value 6.1 of the dye exhaustion rate. The actual exhaustion rate signal is compared with a nominal dye exhaustion rate signal which is fed at a command input 7.1 to a comparator 7, which provides a deviation or error signal 7.2 to a controller 8 as an exhaustion rate setting. The dye exhaustion controller 8, which is a Proportional/Differential controller, has its output connected to a mode selector switch 9, so that a temperature programmer 10, may optionally be used. The output from controller 8, or programmer 10, selectively is connected by switch 9 to the input side of the temperature program Intergrator 11. The input terminals 9.1, 9.2, 9.3 of the Integrator 11 have connected to them a temperature command monitor 12 and a temperature limiter 13 which monitors the maximum deviation and triggers a detection cycle, e.g. if the heating system of the tank 1 is turned off. The limiter 13 is connected via a comparator 16 and a branch conductor 14 to the actual temperature sensor 2. A conductor 15 connects the output 18 from integrator 11 to the comparator 16. The actual temperature value (derived from the temperature sensor 2) is also connected to a combining circuit 17, which, in turn, is connected to a temperature proportional/differential controller 19 combining circuit 17.1 may be a comparator. A conductor 18 from the output terminal of the temperature integrator 11 connected is connected to combining circuit 17.1. The temperature controller 19 is connected to a heat/cool drive module, or temperature setting element 20 which drives the position of the control elements such as valves or electrical switching means for the heating or cooling system (heat/cool media or current) circulating through a coil 1.1 in the dye vat 1.

As could be seen in FIG. 1 the controlling (cascade-) system has two loops
a first (temperature) loop 2-17-17.1-19-19.1-20-20.1-1.1
and a second (dye exhaustion rate) loop 1-3-4-5-6
which can be selected in operation as
a closed (dye exhaustion rate) loop
7-7.2-8-9 (solid line position) -11-18 etc. or
an open program controlled (temperature) loop
10-9 (dotted line position) -9.1-11-18 etc.

OPERATIONAL MODES OF CONTROLLING

Mode selector switch 9 is normally in the position shown in solid lines in FIG. 1. When, under control of a signal from terminal 20.2—as will appear—the mode selector switch 9 is moved to the broken-line position, a preset temperature program from a programmer 10 can be applied to the output of mode selector switch 9. The output 9.1 of switch 9 is applied to the temperature program integrator 11. The integrator 11 provides a temperature command signal at its output 18 to, eventually, control application of heating or cooling medium (or electrical current flow to heating or cooling element, such as a Peltier element) to heat exchanger 1.1 within the vat 1. The temperature program integrator 11 is connected to the output of a temperature command monitor 12 which, in turn, has its input connected to the output of a comparator 21, comparing the actual temperature signal derived from temperature sensor 2 with a stored temperature, stored within the temperature programmer 10. A temperature limiter 13 is connected to the output of a comparator 16 which monitors maximum temperature errors and initiates, for example, a run of the temperature program cycle stored in the temperature programmer 10 by providing an output at line 13.1. The maximum error is determined by comparing in comparator 16 the actual temperature signal on line 14, derived from sensor 2, with the commanded temperature signal on line 15 connected to output line 18 from integrator 11. If this difference exceeds a certain maximum, the temperature limiter 13 will, in one mode of operation control integrator 11 over terminal 9.3 to, limit the output signal at line 18 from signal integrator 11; in another mode of operation, when line 20.2 is energized—as will appear below—the temperature error limiter 13 will provide a signal at line 13.1 to initiate a run of a program cycle within temperature programmer 10. The branch line 14 from the sensor 2 has a signal thereon which is representative of actual temperature; line 15 has the signal on line 18 thereon which is representative of the commanded temperature.

The actual temperature signal on line 17 is, further, connected to a combining circuit 17.1, for example a comparator, which also receives the output signal at line 18 from temperature integrator 11 and forming a corrected temperature control signal. The output from combining circuit or comparator 17.1 is connected to the temperature controller 19 which, preferably, has proportional-differential (P-D) transfer characteristics and is responsive to the difference between actual temperature and commanded temperature to provide at its output 19.1 a signal to setting module 20 which can be a positioning element, for example a valve or the like, selectively controlling application of heating or cooling medium to heat exchanger 1.1, or heating up or cooling down liquor in vat by controlling the flow of electric current to a Peltier element or even a heating coil the heat of which can be removed. Heating and cooling can be continuously increased or diminished.

Figure 5:
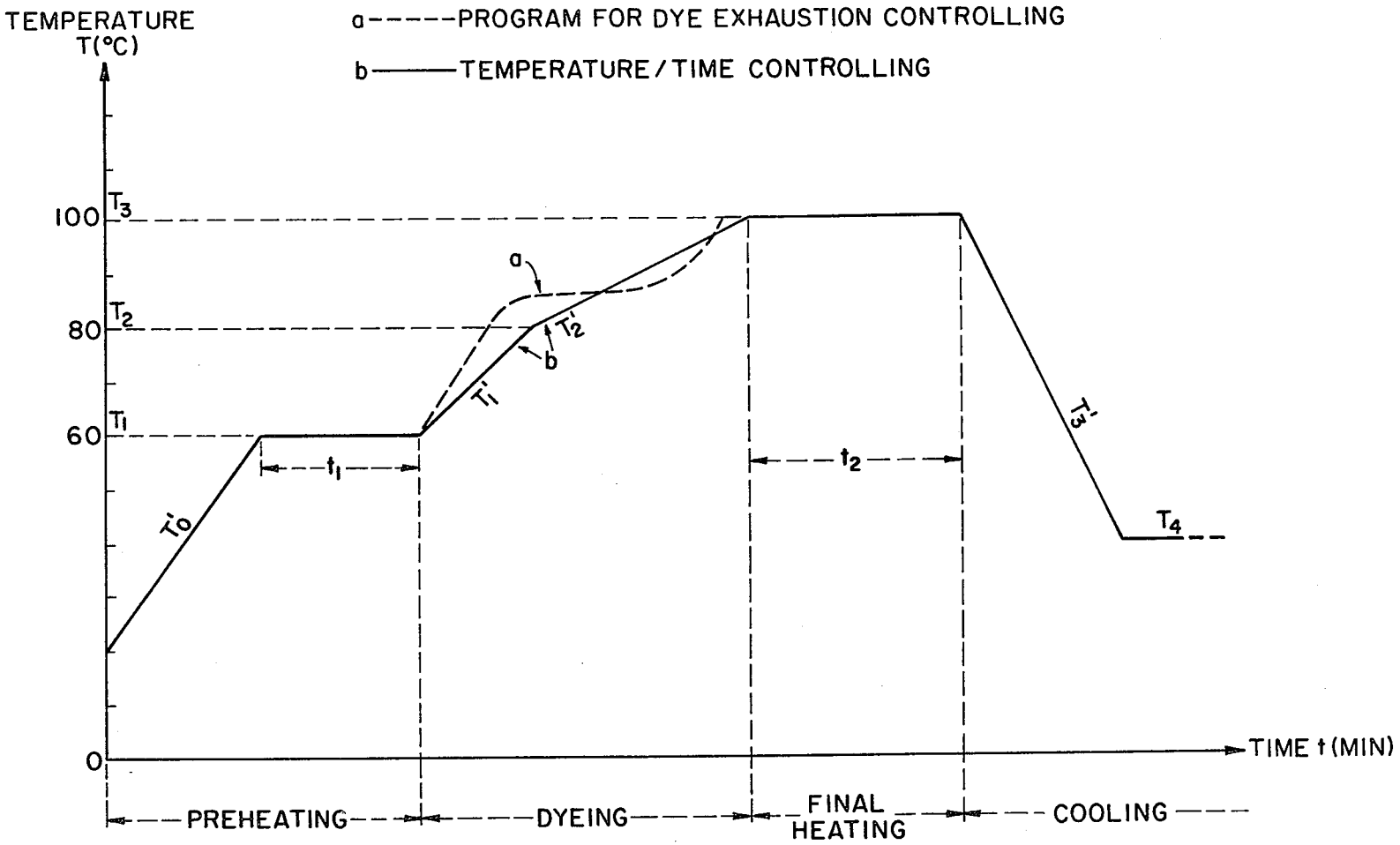
FIG. 5 is a graph showing the temperature/time relationship and dye exhaustion control according to an embodiment of the invention.

If no heating or cooling medium flows through heat exchanger 1.1, for example if the heating/cooling control 20 is disconnected, for example by interrupting heating of dye through or vat 1, the module 20 provides an output signal at line 20.1 which is applied to the temperature command monitor 12 and to the temperature programmer 10. A switching signal from terminal 20.2 is also applied to control transfer of selector switch 9 to the broken-line position, so that temperature program integrator 11 will then be controlled by a search program cycle within unit 10 and by the temperature command monitor 12, rather than by comparison at 7 of the actual dye exhaustion rate signal 6.1 with respect to the command signal nominal exhaustion rate applied at terminal 7.1. The output from integrator 11, applied to temperature controller 19 through combining/comparator circuit 17.1, then can be utilized to reconnect module 20, for example by initiating a cooling cycle subsequent to a heating cycle as for comparison of the actual result obtained by comparator 7. A typical heating and cooling cycle is shown in FIG. 5.

The control system of the invention incorporates apart from its main facility, i.e. control of the exhaustion rate, a conventional preselectable temperature program with high regulating accuracy. For a preheating phase a predetermined temperature can be selected with maximum heating-up rate and this be maintained constant over a variable holding period.

The dyestuff exhaustion phase can be preselected through the described exhaustion control system, but, should this not be utilisable, the system can be run with a temperature program and two selectable heating-up rates (minimum heating-up rate 0.2° C. per minute with a maximum deviation in control of ±5%) and a switch-over temperature as required. The set final dyeing temperature is maintained constant during predetermined holding periods and then switched over to the cooling down rate to an adjustable final temperature value. The possibilities given for the complete program sequence are shown in diagrammatic form in FIG. 5 (temperature versus time).

The sequence is for example:

Preheating, dyeing, final heating, cooling.

Curve a shows in dotted line the dye exhaustion controlling.

Curve b shows in full line the temperature/time controlling.

As a modification of the control system or-mode, take-over of control function by units 10, 12 under control of a signal from line 20.2, for example when the control unit 20 is not commanding admission of heating or cooling medium can also be initiated and controlled from other units within the system, for example from the temperature controller 19; likewise, limiting of the difference signal, as controlled by stage 19, can be achieved in different manner, for example by including limiter stages in unit 19, unit 18, and the like.

Figure 4:
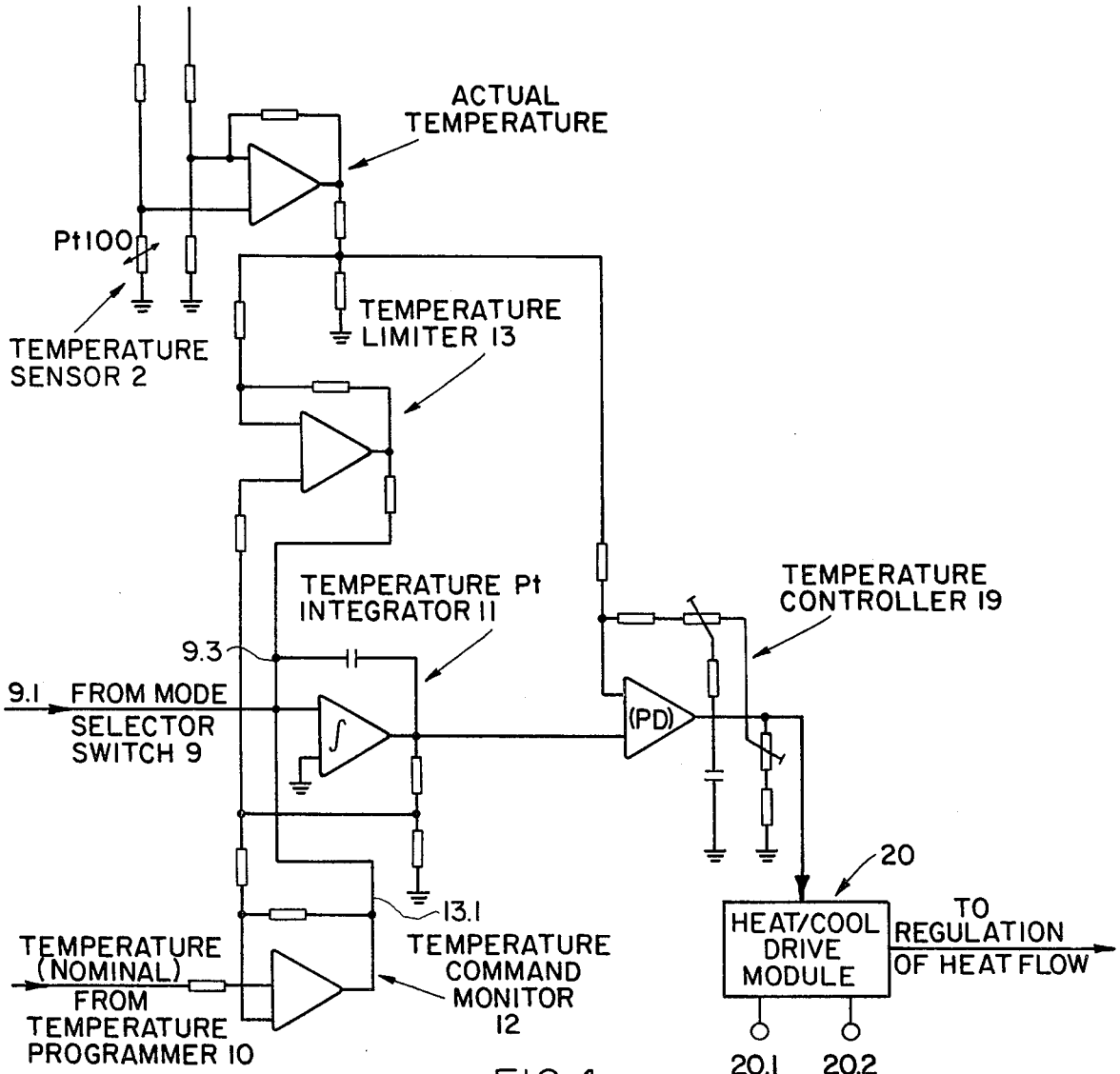
FIG. 4 is a functional diagram of a system as shown in FIG. 3 continued (second part)
Figure 3:
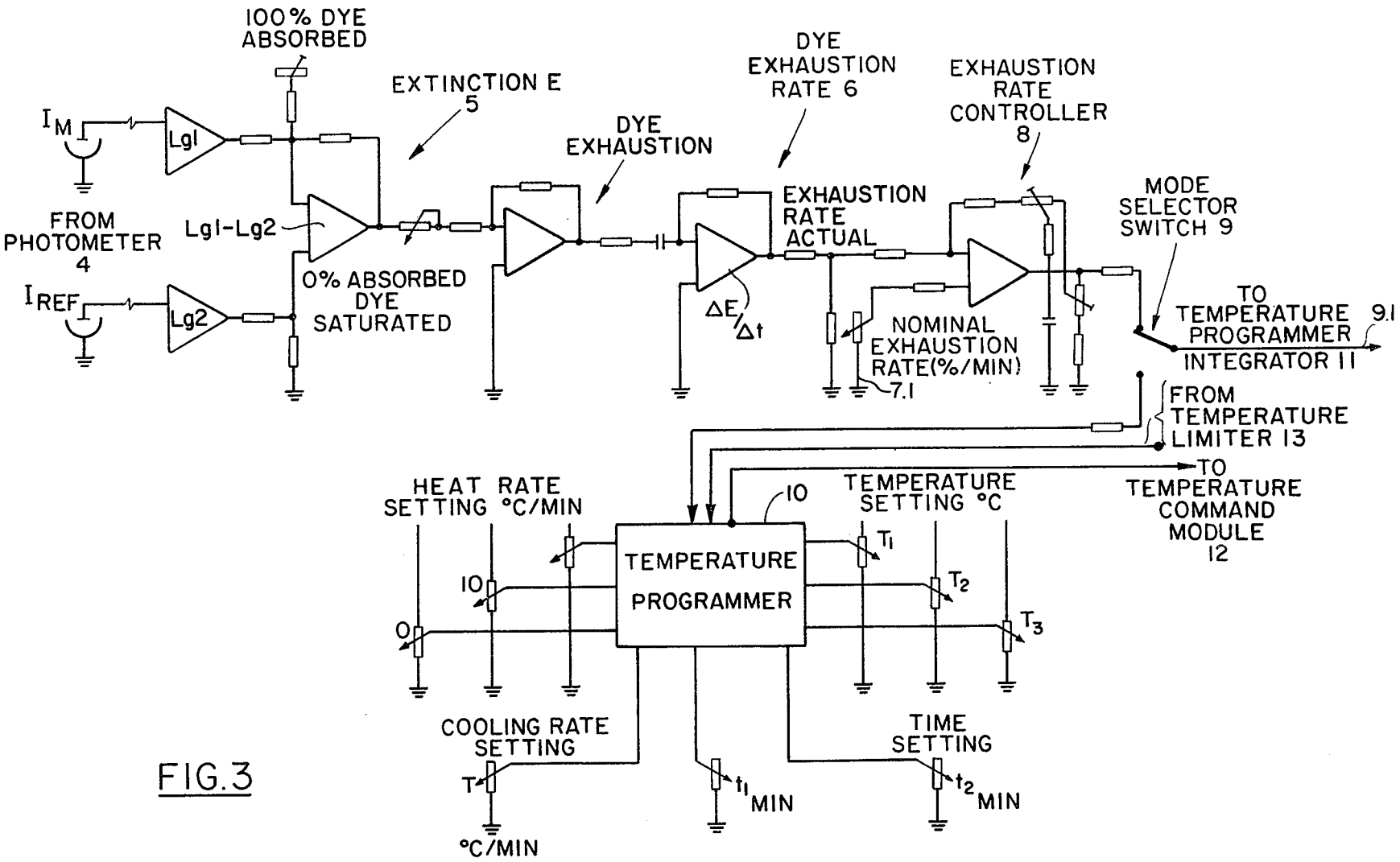
FIG. 3 is a functional diagram of one embodiment of a control system according to the invention (first part)

In FIG. 3 and FIG. 4 there is shown one embodiment of the invention which has proven its advantages in practise in bath dyeing operations, particularly in polyacrylonitrile dyeing. The positions (reference numerals) of FIG. 1 are given in parentheses for comparison of the examples of stages or modules in FIG. 3 and FIG. 4 with that of FIG. 1 respectively.

The output signals of the dual beam photometer i.e. of their photocells, namely

I Measured and I Reference (small currents in the mA range), are the inputs at FIG. 3 (left) to the logarithmatic module (5) having a resistor and amplifier circuit as shown schematically and functionally with variable resistor elements as setting elements for between 0 and 100 percent dye absorbance. The dye exhaustion signal is further amplified and differentiated (at 6) by the elements shown to generate a signal according to the actual dye exhaustion rate. At 7 the nominal E' signal is added by command 7.1 and the output signal is transferred to set the PD-controller for dye exhaustion 8.

Selector switch 9 has the following positions:

(a) to connect the exhaustion rate controller 8 with the temperature program integrator 11, (b) to connect the temperature programmer 10 with the program integrator 11.

In the lower part of FIG. 3 is shown the temperature programmer 10 schematically and functionally with variable resistor elements for (pre-)setting heating rates (between 0° and 10° C. per min.), cooling rates (between 0° and 5° C. per min.), and the time (between 0 and 60 minutes).

One output of the temperature programmer 10 is connected with the temperature command monitor 12.

Terminal 9.1 of FIG. 3 (right end) and FIG. 4 (left end) are are connected to the integrator 11 and the PD-temperature controller 19 and from there to the heating/cooling setting module 20.

Integrator 11 gets its signal at terminal 9.3 from limiter 13 which, in turn, gets the actual temperature signal amplified as shown by the circuit of elements in FIG. 4 (upper left) in one mode. The function of the combining circuit 17.1 is combined in PD controller 19.

In order to start a search program nominal temperatures are put into programmer 10, the signals are amplified and put into the temperature command monitor 12 as shown in FIG. 4 (lower left). One output line of monitor 12 is, as shown, also connected to the temperature (error signal) limiter 13.

Various changes and modifications could be made without leaving the scope of the invention as defined in the claims.

We claim:

1. A system for controlling the dye exhaustion of at least one color component contained in a dye liquor in a dyer's bath for dyeing of textile materials or the like comprising means (1.1) regulating the temperature of the dye liquor or bath in a vat (1) as a function of change in extinction;

photometric means (4) sensing absorption of at least one color component;

means (5) providing a signal (E) representative of the extinction;

means (6) processing the extinction signal (E) for generating a signal representative of the actual exhaustion rate;

means (7.1) for providing a nominal exhaustion rate signal;

comparator means (7) connected to and controlled by the nominal exhaustion rate signal providing means and the actual exhaustion rate generating means, and generating a dye exhaustion rate setting signal (7.2) as a function of deviation of the actual, from the commanded dye exhaustion rate;

means (8) for controlling dye exhaustion rate connected to and receiving the dye exhaustion rate setting signal, connectable (9) with means (11) generating a signal representative of a temperature to effect dye exhaustion at a predetermined rate and providing a nominal temperature control signal (18) representative of the desired temperature at which dyeing should be performed;

temperature sensing means (2) generating an actual temperature signal (17);

signal combining means (17.1) receiving the actual temperature signal and the nominal temperature signal, and generating a corrected temperature control signal as a function of deviation of the actual from the nominal temperature;

and dye liquor temperature control means (19) controlling the temperature of the dye liquor or bath in the vat (1) under control of said temperature control signal.

2. System according to claim 1, further including a temperature programmer (10) storing information representative for dye exhaustion rate and temperature;

and controllable switch means (9) selectively connecting one of (a) said programmer (10);

(b) said dye exhaustion rate controller (8) to the nominal temperature signal generator (11) to provide to said signal generator, selectively, one of (a) a signal derived from stored, predetermined values within said programmer (10);

(b) a signal (7.2) representative of compared (7) actual (6.1) and commanded (7.1) nominal dy- exhaustion rate.

3. System according to claim 1, further including a temperature command monitor (12) connected to receive and be controlled by a signal representative of actual temperature from said temperature sensing means (2) and having an output connected to said nominal temperature signal generator (11) to monitor and supervise operation of said nominal temperature signal generator (11) as a function of said sensed actual temperature.

4. System according to claim 1, further including a temperature limiter (13) connected to and controlled by a signal representative of the error between actual temperature, as sensed by the temperature sensing means (2), and the nominal temperature signal (18) derived from the nominal temperature signal generator (11), said temperature limiter being connected to limit the maximum nominal temperature signal and hence to limit the maximum heat exchange by said dye liquor temperature regulating means (1.1).

5. System according to claim 1, wherein said signal combining means (17.1) are signal comparator means.

6. A system for controlling the dye exhaustion of at least one color component contained in a dye liquor in a dyer's bath for dying of textile materials or the like comprising means (1.1) for regulating the temperature of the dye liquor or bath in a vat (1) as a function of change in extinction, a photometer (4) having an output signal related to the measured degree of transmission of the dyeing solution or liquor, a logarithmic circuit (5) connected to the photometer and generating a signal for extinction (E);

a differentiator (6) receiving said extinction signal (E) and providing a differentiated rate-dependent exhaustion signal representative of actual exhaustion rate;

control means (7, 8, 11, 19, 20) responsive to the exhaustion rate signal generating a dye exhaustion rate setting signal, and control means connected to receive the exhaustion rate signal and a signal representative of actual dye liquor temperature to control the temperature of the dye liquor as a function of the combination of exhaustion rate and temperature.

7. System according to claim 6, wherein the photometric means comprises a dual beam photometer.

8. System according to claim 6, comprising a first control loop for controlling the temperature of the dye bath including said differentiator (6) deriving the exhaustion rate-dependent signal; a second control loop including a programmer (10) having dye bath temperature information stored therein;

and means (9) for selectively controlling the control means by one of (a) said first loop;

(b) said second loop.

9. Method to control the dye exhaustion of at least one color component contained in a dye liquor in a dye-bath for dyeing of textile materials and the like comprising the steps of photometrically sensing absorption of at least one color component and deriving a photometric sensing signal;

signal processing said photometric sensing signal and generating a processed signal representative of the actual exhaustion rate;

providing a nominal or command exhaustion rate signal;

comparing the actual exhaustion rate and the nominal or command exhaustion rate signals to obtain an exhaustion rate deviation signal;

processing the exhaustion rate deviation signal to obtain a temperature control signal;

sensing the actual temperature of the dye-bath and obtaining an actual temperature signal;

combining the actual temperature signal and the temperature control signal to obtain a temperature correction control signal;

and controlling the temperature of the dye-bath as a function of said temperature correction control signal.

10. Method according to claim 9, including the step of providing a selected temperature program from a stored data source and generating a programmed temperature control signal;

and, selectively, controlling the temperature of the dye-bath as a function of one of:

(a) said temperature correction control signal;

(b) said programmed temperature control signal.

11. Method according to claim 9, including the step of monitoring the actual temperature signal.

12. Method according to claim 9, including the step of setting a temperature limit and deriving a temperature limit signal if the sensed actual temperature deviates from commanded temperature by a value exceeding said limit, and modifying the temperature control signal in the direction to temperature of the bath, and hence the actual temperature signal to fall below said limit.

13. Method according to claim 9, wherein the step of photometrically determining the absorption of the at least one color component comprises passing a portion of the dye-bath through a flow cell (24) of a dual beam photometer to obtain a normalized photometric sensing signal;

and wherein said signal processing step comprises logarithmically transforming and differentiating said normalized signal to obtain said actual exhaustion rate signal.

14. Method according to claim 9, wherein said step of combining the temperature control signal and said actual temperature signal comprises the step of comparing said signals to obtain the corrected temperature control signal.

* * * * *